US006354739B1

(12) United States Patent
Sheehan, Jr. et al.

(10) Patent No.: US 6,354,739 B1
(45) **Date of Patent: *Mar. 12, 2002**

(54) TEAR CONTROL CLOSING TAPE AND CONTAINER WITH TEAR CONTROL CLOSING TAPE

(75) Inventors: Richard L. Sheehan, Jr., Grant, MN (US); Dean A. Miner, Prescott, WI (US); Timothy V. Stagg, Woodbury, MN (US)

(73) Assignee: 3M Innovative Properties Company, St. Paul, MN (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/315,249

(22) Filed: May 20, 1999

Related U.S. Application Data

(63) Continuation-in-part of application No. 09/086,317, filed on May 28, 1998, now abandoned.

(51) Int. Cl.[7] ..... B65D 33/00
(52) U.S. Cl. ..... 383/205; 229/123.2; 229/309
(58) Field of Search ..... 383/205, 78, 89, 383/206; 229/87.05, 123.2, 125.37, 125.38, 125.39, 307, 309

(56) References Cited

U.S. PATENT DOCUMENTS

| | | | | |
|---|---|---|---|---|
| 2,315,116 A | * | 3/1943 | Flizikowski | 229/926 X |
| 2,517,801 A | * | 8/1950 | Roush | 229/87.05 |
| 2,895,865 A | * | 7/1959 | Humphner | 229/123.2 X |
| 3,089,634 A | * | 5/1963 | Heise et al. | 229/123.2 X |
| 3,504,844 A | * | 4/1970 | Stark et al. | 229/125.39 |
| 3,810,813 A | * | 5/1974 | Ellis | 229/123.2 X |
| 3,980,224 A | | 9/1976 | Yasuda | |
| 4,781,296 A | | 11/1988 | Morris et al. | |
| 4,946,723 A | * | 8/1990 | Paules et al. | 229/123.2 X |
| 5,035,328 A | * | 7/1991 | Kim | 383/205 X |
| 5,054,618 A | | 10/1991 | Kim | |
| 5,079,066 A | | 1/1992 | Leseman et al. | |
| 5,080,957 A | | 1/1992 | Leseman et al. | |
| 5,093,187 A | | 3/1992 | Engelmann et al. | |
| 5,203,634 A | * | 4/1993 | Kim | 383/205 |
| 5,213,258 A | * | 5/1993 | Kim | 229/309 X |
| 5,662,420 A | | 9/1997 | Sinda et al. | |

FOREIGN PATENT DOCUMENTS

| | | |
|---|---|---|
| DE | 44 02 444 | 8/1995 |
| EP | 0 447 209 A1 | 9/1991 |
| EP | 0 755 868 A1 | 1/1997 |
| WO | WO 98/56581 | 12/1998 |

* cited by examiner

*Primary Examiner*—Jes F. Pascua
(74) *Attorney, Agent, or Firm*—Jennie G. Boeder

(57) ABSTRACT

A tape for use in closing a container having opposing ends includes a base layer and a tearable tape strip. The base layer includes a tear resistant backing having a first side and a second side, and an adhesive coated on at least part of the first side of the backing. The tearable tape strip is located on the first side of the backing and has a first side and a second side. The tearable tape strip permits tearing of itself and the tear resistant backing with a given force notwithstanding that the tear resistant backing is otherwise not cleanly tearable. The tearable tape strip tears through the base layer when the tape is removed from the container. The tape can include a tab at one of the ends of the tape. The tab is formed by nicks extending from at least one of the ends of the tape and is located at least partially through the tearable tape strip which facilitate beginning tears. The invention is also a container including the tape and a container having means for adhering its flap to the container to close the container and a tearable tape strip on the flap.

23 Claims, 3 Drawing Sheets

TEAR CONTROL CLOSING TAPE AND CONTAINER WITH TEAR CONTROL CLOSING TAPE

This a continuation-in-part of application Ser. No. 09/086,317 filed May 28, 1998, now abandoned.

TECHNICAL FIELD

The present invention relates to adhesive tapes and containers. More particularly, the present invention relates to adhesive tapes for closing containers and containers having closing tape.

BACKGROUND OF THE INVENTION

Containers, such as bags and other packages, must be securely closed to contain their contents. The container must remain closed during storage and shipping and must withstand vibrations and shocks of rough handling. When distribution is complete, the consumer or end-user needs to open the container to remove the contents. Ideally, a container can be opened without tools or special skills. Achieving both secure closure and easy opening is difficult; many containers can be secure for shipment but are difficult to open. For example, multiple wall paper bags of dog food or fertilizer often have sewn tops which remain closed during shipping but are difficult for the end-user to open without tools or without damaging the bag and spilling unused contents.

U.S. Pat. No. 4,781,296 discloses making a Tyvek® spun-bonded olefin envelope openable. It improves upon the common paperboard envelopes which are relatively easy to open using conventional tearable tape strip tape products. This highly tear-resistant envelope material can be fused by ultrasonic sealing, creating lines of weakness. European Patent 447209 discloses an improved opening for Tyvek® envelopes. It uses reinforced strapping tape (or similar tape) which is nicked on the ends to control the direction of the tear through the envelope. It also includes cutting through the Tyvek® material, rather than just weakening it. These patents describe opening devices for light-weight mailing envelopes: they function well in this light weight application but are not readily usable to resist splitting when used on a heavier package because the tape is relatively easy to tear.

European Patent 755868 discloses a paperboard envelope using a single tape to close and open the envelope. A uniaxially-oriented plastic film is adhesive-coated on both sides, allowing it to function as a closing tape as well as an opening tape. The tape is nicked to control the direction of tear. The paperboard material of the envelope provides the tear resistance.

The Minnesota Mining and Manufacturing Company (3M) has sold tear strip tapes for many years. One version of tear strip tape (3M #8612 tape) has a polyethylene terephthalate (PET) backing and a reinforcing filament of polyester yarn or fiberglass coated with a pressure sensitive adhesive (PSA). This tape is applied to the inside of a corrugated box or to the inside of a paperboard mailing envelope. The corrugated board or paperboard is nicked on the outside of the tear strip to provide a tab which the end-user can pull. During opening, the tape remains intact and is not split. The tape pulls and tears through the corrugated board or paperboard. This tear strip tape can only be used in light-weight situations because the force required to tear the tape is relatively low. Other versions use a tensilized polypropylene tape with a PSA and, optionally, a reinforced strapping tape. These types of tear strips can also be applied to the adhesive side of a wider film tape such as a box sealing tape or a heat shrinkable tape. Again, the wide tape is nicked to provide a tab and to initiate tearing. The distance between nicks is wider than the tear strip. This is only used for lightweight packages because the nicks tend to propagate prematurely during shipping, if used on a heavier shipping container. Using this kind of conventional tear strip on a linear low density polyethylene (LLDPE) tape backing would not function because the tear strength and the elongation of the LLDPE is too high.

Lightweight film tear strip (with a PSA or with a heat-activated adhesive) is also applied to film overwraps on packages. One example is a pack of cigarettes.

SUMMARY OF THE INVENTION

A container for storing items has a flap for closing the container. The flap has first and second major surfaces and is formed of a tear resistant film material. The container includes means for adhering the first major surface of the flap to the container to close the container and a tearable tape strip. The tape strip is located on one of the first and second major surfaces of the flap, and permits tearing of itself and the flap with a given force notwithstanding that the tear resistant film flap is otherwise not cleanly tearable.

The tearable tape strip can be located on the first major surface of the flap such that tearing the tearable tape strip tears through the flap. The means for adhering the first major surface of the flap to the container can include an adhesive on at least part of the first major side of the flap, the container, or both.

In another embodiment, a tape for use in closing a container having opposing ends includes a base layer and a tearable tape strip. The base layer includes a tear resistant backing having a first side and a second side, and an adhesive on at least part of the first side of the backing. The tearable tape strip is located on the first side of the backing and has a first side and a second side. The tearable tape strip permits tearing of itself and the tear resistant backing with a given force notwithstanding that the tear resistant backing is otherwise not cleanly tearable. The adhesive can be located between the backing and the tearable tape strip and the tearable tape strip tears through the base layer when the tape is removed from the container.

The tear resistant backing can be LLDPE, low density polyethylene LDPE, cast polypropylene, and Kraton/polypropylene blends. The tearable tape strip can be one of reinforced strapping tape, tensilized polypropylene, and filament reinforced tape. The tearable tape strip can have at least one of filaments and ribs.

The tape can include a tab at one end. The tab is formed by nicks extending from at least one of the ends of the tape and is located at least partially through the tearable tape strip which facilitate beginning tears. In one version, at least one nick has a first portion and a second portion. The first portion extends from at least one of the ends of the tape and passes through only the base layer and the second portion passes through the tearable tape strip. This allows the tab to adhere to the container to reduce the risk of the container opening before the proper time.

The tape can include a means for indicating whether the container has been opened and reclosed. Using linear low density polyethylene as the tear resistant backing causes the torn edge of the tape to be distorted such that recovering the opened tape is noticeable even when covered with additional tape.

DETAILED DESCRIPTION

Figure 1:
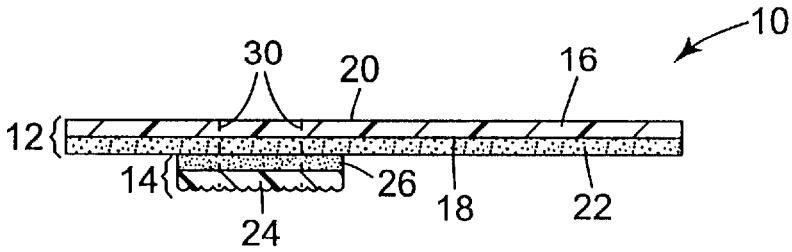
FIG. 1 is a cross-sectional view of a tape of the present invention.

This invention is a tape which functions both to close a container 9 and also to provide a mechanism to easily open the container. Although the container 9 can be any container such as envelopes and boxes, the invention works particularly well on flexible containers such as bags like multiple wall paper bags for storing granular material. As shown in FIG. 1, the tear strip tape 10 combines a base layer 12 which is a tear-resistant tape, with a tearable tape strip 14. The base layer 12 includes a tear resistant backing 16 having a first side 18 and a second side 20, and an adhesive 22 which in the illustrated embodiments is located on the first side 18 of the backing 16. The adhesive 22 can be applied to the backing 16 by any known method such as knife coating.

The tearable tape strip 14 can be attached to either the first side 18 or the second side 20 of the backing 16 of the base layer. In the illustrated embodiments, the tearable tape strip 14 is adhered to the first side 18 of the backing 16 using the adhesive 22. In use, the tearable tape strip 14 is located on the container 9 between the container and the base layer 12, without adhering to the container. In the illustrated embodiments, the tearable tape strip 14 includes a base layer 24 and its own adhesive 26 on one side of the base layer to assist adherence to the base layer 12 of the tear strip tape 10. In another embodiment, the adhesive 26 is on the other side of the tearable tape strip base layer 24 to adhere to the container 9. In another embodiment, the tearable tape strip 14 need not include an adhesive.

The backing 16 can be a linear low density polyethylene (LLDPE), low density polyethylene (LDPE), cast polypropylene, Kraton/polypropylene blends, or other tear resistant film. The tearable tape strip 14 can be tearable filament reinforced tape or a reinforced strapping tape (RST) having filaments or ribs 28. Suitable RSTs are described in U.S. Pat. Nos. 5,079,066 and 5,080,957. The tearable tape strip 14 could also be tensilized polypropylene or other oriented or non-oriented films which tear preferentially in the longitudinal direction. The ribs 28 constrain the tears in the tearable tape strip 14 to control the direction of tear. Nicks 30 in the tearable tape strip 14 form an end tab 32 and initiate points of tear. Stress from handling the container 9 is concentrated at these points. The tear resistant base layer 12 prevents the tear from propagating prematurely, yet allows a person to pull the end tab 32 to easily open the container 9. A wide variety of tear resistant tapes 12 are available. By balancing the strength, premature splitting, and ease of opening, a tape 10 with the desired overall characteristics can be achieved. Containers 9 have been closed with this invention and have been subjected to severe rough handling tests. They have successfully withstood these stresses yet have allowed easy opening. This tape 10 uses a weakness of the tearable tape strip 14, such as RST, (its tendency to split in the longitudinal or machine direction) coupled with an inability to tear cleanly through the tear resistant backing to form a very functional opening feature for containers. Cleanly tear means to tear open consistently, with a relatively uniform tearing force, without excessive distortion of the torn film. There are not extended stretched-out or jagged edges.

Figure 2:
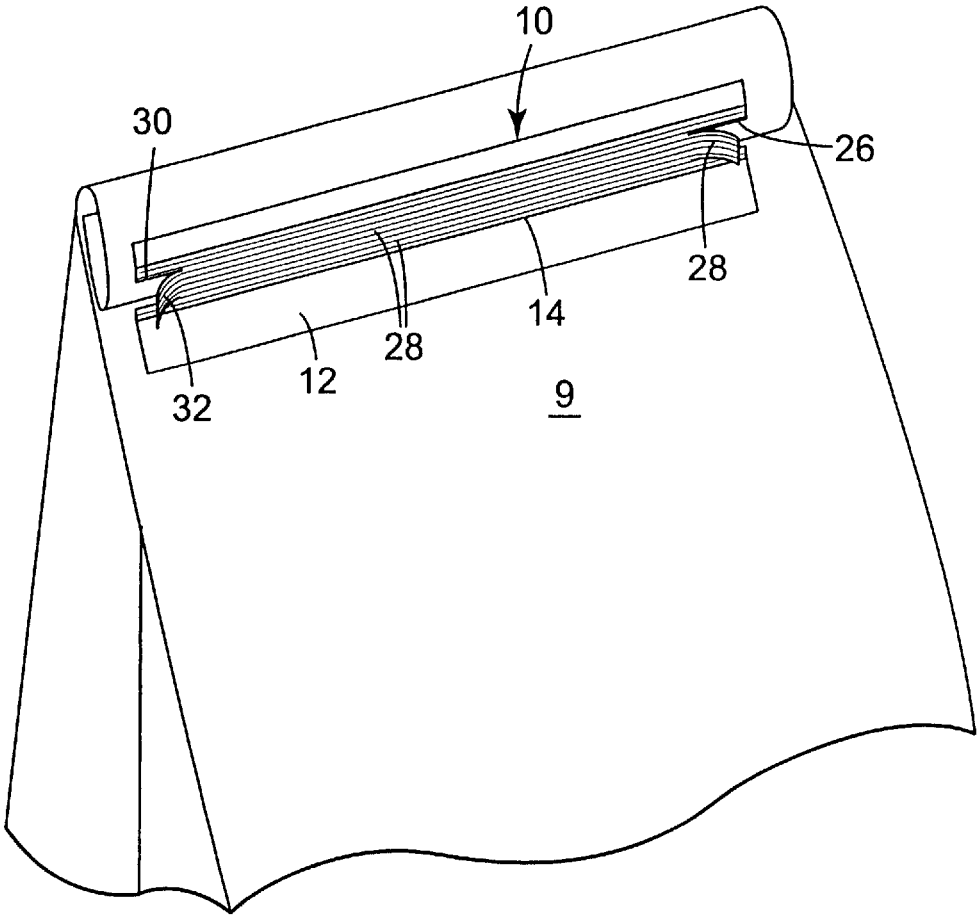
FIG. 2 is a perspective view of the tape of FIG. 1 applied to a container.

One embodiment of this invention is shown in FIG. 2. A backing 16 made of tear resistant film such as LLDPE and an adhesive 22 such as PSA functions as the base layer 12 which closes the container 9. A narrower filament reinforced tape or reinforced strapping tape is the tearable tape strip 14 and is laminated to the tear resistant base layer 12, adhesive to adhesive. Nicks 30 through the tape 10 initiate points of tear. The nicks 30 are located through both the base layer 12 and the tearable tape strip 14 of the tape 10. The tape 10 is applied to the container 9. The end tabs 32 formed at the end of the tape assist opening the container 9.

Figure 3:
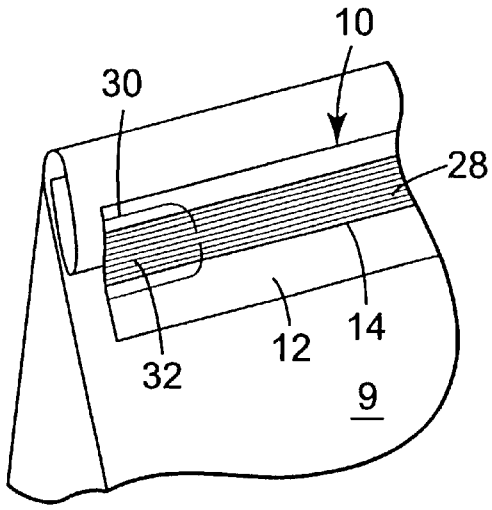
FIG. 3 is a partial perspective view of another embodiment of the tape applied to a container.

In an alternative embodiment, shown in FIG. 3, the end tabs 32 can lay flat against the container 9 during shipping and distribution. In this version, the nicks 30 start from the end of the tape 10 at a location such that they pass through only the base layer 12. The distance between the nicks 30 is greater than the width of the end tab 32. As shown, the nicks are then directed to pass through part of the tearable tape strip 14 as well as the base layer. This direction change is shown as a smooth curve, but any shape can be used. The key to this feature is that at the end of the tape, the end tab 32 includes part of the tape 10 with adhesive 22 to allow adhesive of the closure tape to hold lightly onto the bag, while the end tab 32 has at least a portion that extends through the tearable tape strip 14.

Figure 4:
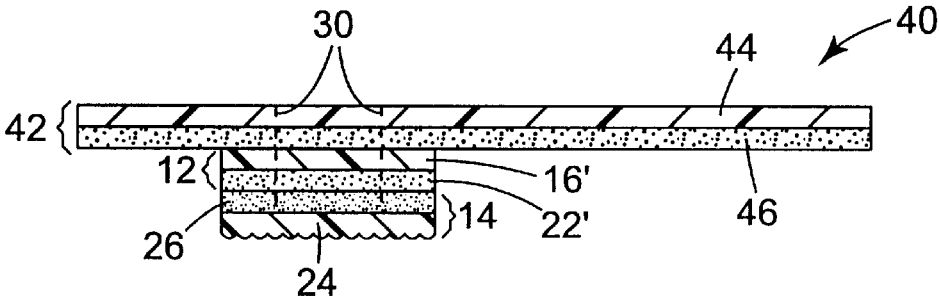
FIG. 4 is a cross-sectional view of a tape according to another embodiment of the present invention.

In another embodiment shown in FIG. 4, tape 40 includes a tape layer 42 that is a strip of film tape, such as a box sealing tape made of biaxially oriented polypropylene. The tape layer 42 includes a backing 44 and an adhesive 46. This tape layer 42 is not tear resistant when nicked but provides good closure strength at a low cost. The narrower tearable tape strip 14 is laminated to a tear resistant tape 12 of a similar width, such as a 3M #8883 tape. The tearable tape strip 14 includes a base layer 24 and an adhesive 26 and the tear resistant tape 12 includes a base layer 16' and an adhesive 22' although the adhesive is not required. The tear resistant tape 12 is located only in the area where its function is required, the area straddling the two portions of the container 9 that are adhered to each other to close the container. (Note that if a box sealing tape was used with RST without a tear resistant film, nicks in the RST would propagate too easily.) This embodiment, like that of FIG. 1, prevents a tear from propagating prematurely, yet allows a person to pull the end tab 32 to easily open the container 9.

Figure 5:
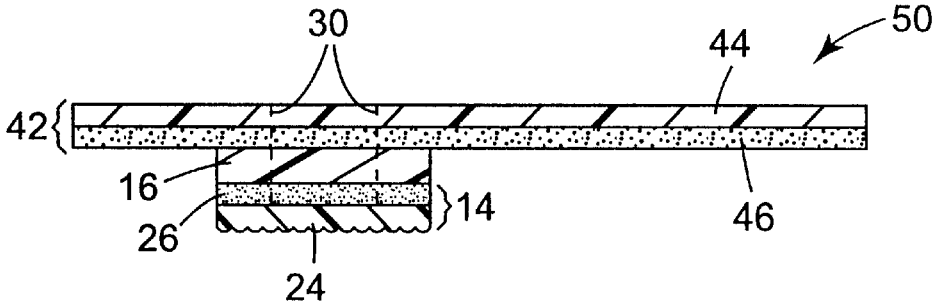
FIG. 5 is a cross-sectional view of a tape according to another embodiment of the present invention.

This structure could be formed in several ways. One way is that the tear resistant tape 12, such as #8883 tape, made by 3M, St. Paul, Minn., could be laminated between the box sealing tape layer 42 and the tearable tape strip 14 at the point of application. In another method, an RST tape could be used as the tearable tape strip 14 and could be laminated to tear resistant tape 12 (3M #8883 tape) and provided to a customer in roll form. This would be applied to the box sealing tape layer 42 at the point of application. Yet another method involves putting all of the layers together during manufacturing. A tear resistant tape 12 is coated or laminated to a tearable tape strip 14. This multiple layer configuration is then attached to a tape layer 42 which includes a backing 44 and an adhesive 46. FIG. 5 shows an embodiment where there is no adhesive on the tear resistant layer. The tear resistant base layer 16 only is located between the tape layer 42 and the tearable tape strip 14 to form tape 50.

In one example, a 20 kg (44 lb) bag of dog food was closed with a 40.6 cm (16 in) long strip of 48 mm wide tear resistant adhesive base layer 12, such as 3M #8883 tape, having a 0.008 cm (3 mil) LLDPE backing 16 and a PSA adhesive 22. (The 3M #8883 tape is a "stretchable tape" which is used here for its tear resistant properties.) A 12 mm wide strip of tearable tape strip 14 (3M #864 RST tape) was applied and nicks 30 were formed in the ends to create end tabs 32. This bag was subjected to drop tests according to ASTM D5276 standards. Drops of 76 cm (30 in) were made on the front, back, two sides, and two ends of the bag. The bag completed the six drops without opening. The bag was then lifted up several times by its "ears," the notches formed by the gussets, without opening and without the nicks propagating. The bag was easily opened by pulling the tab.

A similar bag of dog food was closed with a tape having 48 mm wide box sealing tape (3M #372 tape) laminated to 12 mm wide 3M #8883 tape and 12 mm wide 3M #864 tape. Some bags were also closed with a structure of 48 mm wide box sealing tape and a 12 mm wide lamination of 3M # 864 tape and a 0.008 cm (3 mil) LLDPE film, and other bags were closed with a 0.010 cm (4 mil) LDPE film. This structure also completed the drop tests and lifting tests well, followed by being easily opened.

To measure the forces required to open the tape structures, tests were conducted on a ZPE 1000 High Rate Peel Test System, by Instrumentors, Inc. Tests were conducted at 0.5 m/s (which is representative of the actual speed used by end-users) and the force required to pull a tab (with two tears through the tape) was measured in Newtons. The following table summarizes the results. Tests at other speeds were also conducted. The results at these speeds were predictable; lower speeds yielded increased forces and higher speeds yielded decreased forces. At all speeds, there were similar force differences among the various tape samples.

| EXAMPLE NUMBER | BASE LAYER | TEARABLE TAPE STRIP | FORCE (N) |
|---|---|---|---|
| Comparative #1 | #864 RST | #864 RST | 2.5 |
| Comparative #2 | #372 Box Sealing Tape | #864 RST | 1.8 |
| Comparative #3 | #372 Box Sealing Tape | #8612 (nicks along sides) | 0.2 |
| 1 | #8883 Stretchable Tape | #854 RST | 12.8 |
| 2* | #8883 Stretchable Tape | #864 RST | 9.1 |
| 3* | 4 mil LDPE | #864 RST | 5.1 |

*Includes #372 Box Sealing Tape overlying the Base Layer.

This table illustrates that using a tear resistant film (3M #8883 tape in the examples) in the structure significantly increases the force required to tear and thus decreases the chance of premature opening of the container. If a standard tear strip tape such as 3M #8612 (with nicks along the sides) is used with #8883, the LLDPE backing deforms and elongates but it does not provide a functional tear. However, an example using a single tape construction of #8883 Stretchable Tape did not work. The tape broke without tearing along its length.

Figure 6:
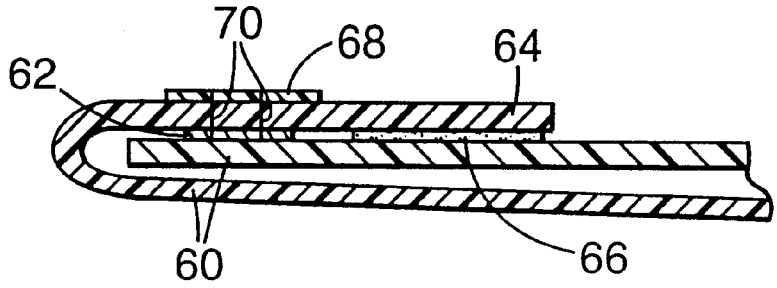
FIG. 6 is a cross-sectional view of a container according to another embodiment of the present invention.
Figure 7:
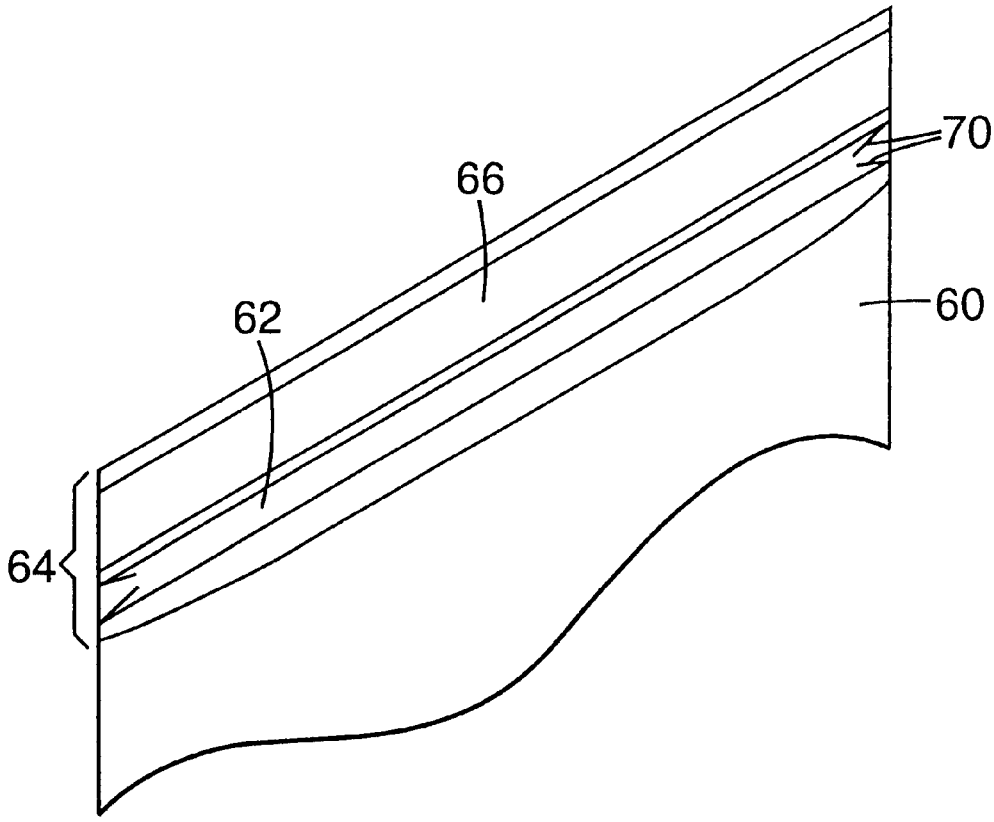
FIG. 7 is a perspective view of the container of FIG. 6.

In another embodiment, shown in FIGS. 6 and 7, a container 60 includes a tape for sealing the container. The container 60 can be flexible and can be a bag. The tape can be a tearable tape strip 62 and can be part of the container 60 in a way to simplify the tape. For example the container 60 can have a flap 64 for closing the container. The flap 64 has first and second major surfaces and is formed of a tear resistant film. Film is defined as being continuous and made from material other than sheetstock. (Sheetstock is defined as material that is made of fibers. The fibers can be felted, matted, beaten, or refined, and can be made of cellulose, as with traditional paper, or of other materials, including synthetic and plastic materials that can be bonded together.)

The flap 64 can be weakened (such as by slits, perforations, or score lines) along subsequent tear lines. As shown, the flap 64 is unweakened. Unweakened means that there are no slits, perforations, or score lines crossing the flap, and the flap is untreated in any way intended to weaken it. The tearable tape strip 62 and the flap 64 can have nicks 70 at their ends to facilitate beginning the opening process. These nicks 70 can form a tab and do not weaken the flap 64 because the flap is make of a tear-resistant plastic. The flap 64 need not be weakened because the tearable tape strip 62 makes the otherwise tear-resistant film relatively easy to tear to open the container. This is a significant difference from the known sheet stock envelopes and containers which require weakening in order to function well. Weakening involves extra manufacturing steps and increased costs.

The container 60 includes a mechanism, such as glue or adhesive 66, that adheres the first major surface of the flap to the container to close the container. The adhesive 66 can be coated on at least part of the first major side of the flap 64, or on the other part of the container 60, or on both. The adhesive 66 can optionally be protected by a release liner before the container 60 is closed. The tearable tape strip 62 is located on either or both of the first and second major surfaces of the flap 64. The tearable tape strip 62 permits tearing of itself and the flap 64 with a given force notwithstanding that the tear resistant film flap 64 is otherwise not cleanly tearable.

If the tearable tape strip 62 is located on the first major surface of the flap 64, tearing the tearable tape strip tears through the flap. In this version, an optional cover tape 68 can be located on the second major surface of the flap 64, opposite the tearable tape strip, as shown in FIG. 6. The cover tape 68 improves the ability to tear cleanly through the flap 64, perhaps by constraining the elongation of the flap during tearing. This is shown by the decreased force required for Example 2, which uses a box sealing tape, as compared with Example 1, which does not. Various tapes can be used as a cover tape 68 including #371 Biaxially Oriented Polypropylene (BOPP) Box Sealing Tape, #355 PET Box Sealing Tape, #821 Acetate Tape, and #600 Polyvinyl Chloride (PVC) Tape, all made by 3M, St Paul, Minn. These tapes all have lower elongation than the film used for the flap 64.

The flap 64 can be made of LLDPE, LDPE, cast polypropylene, and blends of Kraton and polypropylene. The tearable tape strip 62 can be RST, tensilized polypropylene, and filament reinforced tape. Also, the tearable tape strip 62 can include filaments, ribs, or both, formed on either or both of its first and second sides.

What is claimed is:

1. A container for storing items comprising:

a flap for closing the container, wherein the flap has first and second major surfaces and is formed of a tear resistant film material which is (a) unweakened, and (b) has a tear strength and elongation such that it does not tear when pulled, but elongates and deforms;

adhesive means for adhering the first major surface of the flap to the container to close the container; and a tearable tape strip located on one of the first and second major surfaces of the flap, wherein the tearable tape strip permits tearing within itself and the flap with a given force notwithstanding that the tear resistant film flap is otherwise not cleanly tearable.

2. The container of claim 1 wherein the tearable tape strip is located on the first major surface of the flap such that tearing the tearable tape strip tears through the flap.

3. The container of claim 1 wherein the adhesive means for adhering the first major surface of the flap to the container comprises an adhesive on at least one of (a) at least part of the first major side of the flap and (b) the container.

4. The container of claim 1 wherein the container is at least one of flexible and a bag.

5. The container of claim 1 wherein the flap comprises one of LLDPE, LDPE, cast polypropylene, and Kraton/polypropylene blends.

6. The container of claim 1 wherein the tearable tape strip is one of RST, tensilized polypropylene, and filament reinforced tape.

7. The container of claim 1 wherein the tearable tape strip comprises at least one of filaments and ribs formed on at least one of the first and second sides of the tearable tape strip.

8. The container of claim 1 further comprising a cover tape located on the second major surface of the flap opposite the tearable tape strip.

9. A tape for use in closing and subsequent opening of a container having opposing ends and comprising:

a base layer comprising a continuous tear resistant film backing which is (a) unweakened, and (b) has a tear strength and elongation such that it does not tear when pulled, but elongates and deforms, said base layer having a first side and a second side;

a tearable tape strip located on the first side of the backing and having a first side and a second side, wherein the tearable tape strip tears within itself and the tear resistant backing with a given force notwithstanding that the tear resistant backing is otherwise not cleanly tearable;

first adhesive means for adhering the base layer to the tearable tape strip; and second adhesive means for adhering the tape to the container to close the container for subsequent opening;

said second adhesive means located on the first or second side of the backing and extending beyond the first adhesive means.

10. The tape of claim 9 wherein the first means and the second means comprise an adhesive on at least part of the first side of the backing, and wherein the adhesive is located between the backing and the tearable tape strip and wherein the first side of the tearable tape strip faces the adhesive such that the tearable tape strip tears through the base layer when the tape is removed from the container.

11. The tape of claim 9 wherein the tear resistant backing is one of LLDPE, LDPE, cast polypropylene, and Kraton/polypropylene blends.

12. The tape of claim 9 wherein the tearable tape strip is one of RST, tensilized polypropylene, and filament reinforced tape.

13. The tape of claim 9 wherein the tearable tape strip comprises at least one of filaments and ribs formed on at least one of the first and second sides of the tearable tape strip.

14. The tape of claim 9 wherein the tape comprises a tab at one of the ends of the tape, wherein the tab is formed by nicks extending from at least one of the ends of the tape and located at least partially through the tearable tape strip which facilitate beginning tears.

15. The tape of claim 14 wherein at least one nick has a first portion and a second portion, wherein the first portion extends from at least one of the ends of the tape and passes through only the base layer and wherein the second portion passes through the tearable tape strip, thereby to allow the tab to adhere to the container to reduce the risk of the container opening before the proper time.

16. The tape of claim 9 further comprising means for indicating whether the container has been opened and reclosed comprising linear low density polyethylene as the tear resistant backing which causes the torn edge of the tape to be distorted such that recovering the opened tape is noticeable even when covered with additional tape.

17. The tape of claim 9 further comprising a tape layer overlying the base layer, and the base layer and the tearable tape strip have similar widths, and further comprising third adhesive means for adhering the tape layer to the base layer.

18. The tape of claim 17 wherein the tape layer is wider than the base layer.

19. The tape of claim 17 wherein the tape layer is wider than the base layer.

20. A container for storing items having an opening for inserting and removing said items from said container comprising the tape of claim 9 applied thereto to close said opening and wherein the tape securely closes the container to prevent the container from discharging the items before desired while permitting easy opening of the container to discharge the items when desired.

21. The tape of claim 9 wherein the force required to pull the tape to open the container is at least 5.1 N.

22. The tape of claim 9 wherein the base layer is wider than the tearable tape strip.

23. A container for storing items comprising:

a flap for closing the container, wherein the flap has first and second major surfaces and is formed of a tear resistant film material which is (a) unweakened, and (b) has a tear strength and elongation such that it does not tar when pulled, but elongates and deforms;

adhesive means for adhering the first major surface of the flap to the container to close the container; and means for opening the container consisting essentially of a tearable tape strip located on the first major surface of the flap such that when the adhesive means closes the container, tearing the tearable tape strip tears through the flap, wherein the tearable tape strip tears within itself and the flap with a given force notwithstanding that the tear resistant film flap is otherwise not cleanly tearable.

* * * * *

UNITED STATES PATENT AND TRADEMARK OFFICE

CERTIFICATE OF CORRECTION

PATENT NO. : 6,354,739 B1 
DATED : March 12, 2002
INVENTOR(S) : Richard L. Sheehan, Jr., Dean A. Miner and Timothy V. Stagg It is certified that error appears in the above-identified patent and that said Letters Patent is hereby corrected as shown below:

Column 7,
Line 45, delete the word "first" and insert in place thereof -- grist --.

Column 8,
Line 44, delete the word "tar" and insert in place thereof -- tear --.

Signed and Sealed this

Nineteenth Day of November, 2002

*Attest:*

*Attesting Officer*

JAMES E. ROGAN
*Director of the United States Patent and Trademark Office*